United States Patent [19]

Shiino et al.

[11] Patent Number: 4,519,659

[45] Date of Patent: May 28, 1985

[54] SOCKET-TYPE CONNECTOR FOR FLAT CABLES

[75] Inventors: Mitsuo Shiino; Akio Nakamura, both of Saitama, Japan

[73] Assignee: Shin-Etsu Polymer Co., Ltd., Tokyo, Japan

[21] Appl. No.: 558,839

[22] Filed: Dec. 7, 1983

[30] Foreign Application Priority Data

Dec. 7, 1982 [JP] Japan ..... 57-185496[U]

[51] Int. Cl.[3] ..... H01R 9/07; H01R 11/11

[52] U.S. Cl. ..... 339/59 M; 339/97 P; 339/98; 339/99 R; 339/176 MF; 339/DIG. 3

[58] Field of Search ..... 339/17 F, 50 R, 50 M, 339/61 M, 97 R, 97 P, 98, 99 R, 176 MF, DIG. 3

[56] References Cited

U.S. PATENT DOCUMENTS

| | | | |
|---|---|---|---|
| 3,509,296 | 4/1970 | Harshman et al. | 339/DIG. 3 |
| 3,877,770 | 4/1975 | Saunders et al. | 339/176 MF |
| 3,998,512 | 12/1976 | Anhalt et al. | 339/17 CF |
| 4,199,637 | 4/1980 | Sado | 339/59 M |
| 4,252,990 | 2/1981 | Sado | 339/59 M |
| 4,415,215 | 11/1983 | Goozner | 339/98 |

*Primary Examiner*—Gil Weidenfeld
*Assistant Examiner*—Paula Austin
*Attorney, Agent, or Firm*—Hill, Van Santen, Steadman & Simpson

[57] ABSTRACT

The invention provides a socket-type connector for connecting a flat cable and a circuit board and the connector has a very simple structure and is free from the problem of corrosion in the metal-made parts in addition to the high reliability of the connection. The connector is formed of an insulating base plate with a plurality of parallel slots for receiving each one of the exposed ends of the cable wires and an anisotropically conductive rubbery sheet bonded on one surface of the base plate, the sheet coming into contact with the ends of the cable wires put into the slots while the terminals of a circuit boards are contacted with the other surface of the anisotropically conductive sheet to establish unidirectional electric connection between them on the opposite sides of the sheet. The flat cable placed on the base plate with the cable wires in the slots is fixed at the position with a cover member having spike pins piercing the flat cable and thrusted into the base plate.

4 Claims, 3 Drawing Figures

SOCKET-TYPE CONNECTOR FOR FLAT CABLES

BACKGROUND OF THE INVENTION

The present invention relates to a socket-type connector for flat cables or, more particularly, to a connector for flat cables capable of connecting flat cables with high reliability, resistance against corrosion and stability against mechanical shocks and vibrations.

There are known various types of connectors for flat cables on the market. Each of them has a basic structure comprising a plug part for fixing the end of the flat cable to a lead wire and a jack part which serves to receive the lead wire and fix it to a substrate plate or circuit board with electric connection. Since the electric connection is obtained by thrusting this jack part into a socket made of an insulator and conductor, certain inconveniences are unavoidable when it is desired to electrically connect a multiplicity of terminal contact points with each other. Furthermore, such a connector is usually expensive because the parts of metal should be imparted with anti-corrosiveness by plating with gold or the like precious metal and the structure thereof is very complicated while the performance of such a connector is not always satisfactory sometimes with troubles in connection.

On the other hand, an alternative method is already well known in which the electric connection between a connecting part of an electrode assembly having a large number of contact points and a substrate plate having a large number of electroconductive stripes corresponding to the contact points is established through an anisotropically electroconductive sheet having electroconductive fibers oriented in a matrix of an insulating material in the direction of the thickness of the sheet. When such a method is applied to the electric connection of flat cables, however, there is a disadvantage that, when the insulating material at the end portion of the flat cable has been removed to expose the metal-made cable wires for electric connection, cross contact of the wires may take place so that no exact one-to-one connection can be obtained between each of the cable wires and one of the electrodes on the substrate plate corresponding thereto.

SUMMARY OF THE INVENTION

It is therefore an object of the present invention to provide a novel and improved connector for flat cables free from the above described problems and disadvantages in the conventional connectors used for the same purpose.

The inventive connector for flat cables comprises a base plate provided with a plurality of slots running in parallel with each other, each slot serving to receive one of the exposed cable wires of the flat cable, and an anisotropically electroconductive sheet applied or bonded to one of the surfaces of the base plate to cover the slots, the direction of electric conduction thereof being perpendicular to the surface of the sheet.

DETAILED DESCRIPTION OF THE PREFERRED EMBODIMENTS

Figure 1:
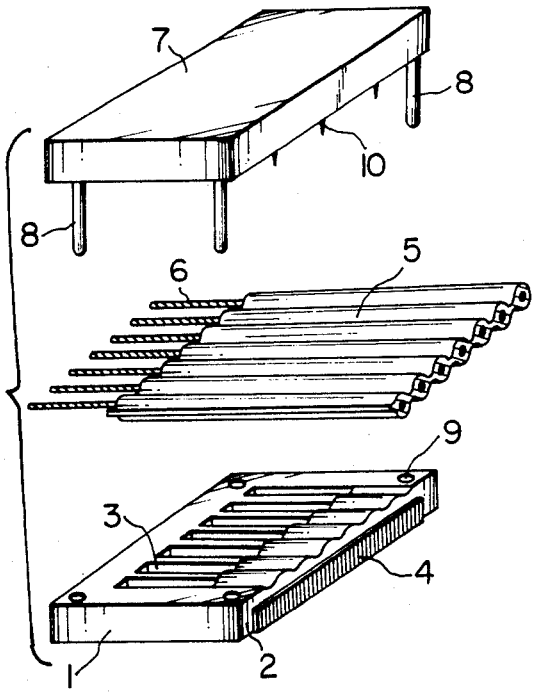
FIG. 1 is a perspective view of the inventive connector disassembled into a base plate and a cover member with the end portion of a flat cable therebetween.

The basic structure of the inventive connector is illustrated with reference to FIG. 1 which is a perspective view of the connector disassembled into a base plate 1 and a cover member 7. The base plate 1, which is typically of a rectangular form, is made of an electrically insulating material such as synthetic resins including polyethylene, polypropylene, polyvinyl chloride, polystyrene and the like thermoplastic resins and provided with a plurality of slots 3 running in parallel with each other. The number of these slots 3 should be equal to or larger than the number of the cable wires 6 of the flat cable 5 to be connected by the connector since each of the slots 3 serves to receive one and only one of the cable wires 6 of the flat cable 5. The dimension of each of the slots 3 should of course be sufficient to receive the naked end portion of one of the cable wires 6 of the flat cable 5. It is sometimes advantageous that the width of the slot 3 is so small that the naked end portion of the cable wires 6 can be pushed thereinto only forcibly by pressing from above so that the cable wire 6 once put into the slot 3 does not get out thereof readily.

On one surface of the base plate 1, i.e. the lower surface thereof in the figures, an anisotropically electroconductive sheet 4 is applied or bonded to the base plate 1 to cover the slots 3. The anisotropic conductivity of the sheet 4 is obtained by the oriented dispersion of electroconductive fibers in a matrix of an insulating material. The direction of the fiber orientation in this case should be perpendicular to the surface of the sheet 4 so that the sheet 4 is conductive only in the direction of the thickness but insulating within the plane of the sheet 4. Therefore, the end portions of the cable wires 6 exposed by removing the insulating material of the flat cable 5 and inserted each in one of the slots 3 of the base plate 1 to contact the sheet 4 are still insulated from each other.

Figure 2:
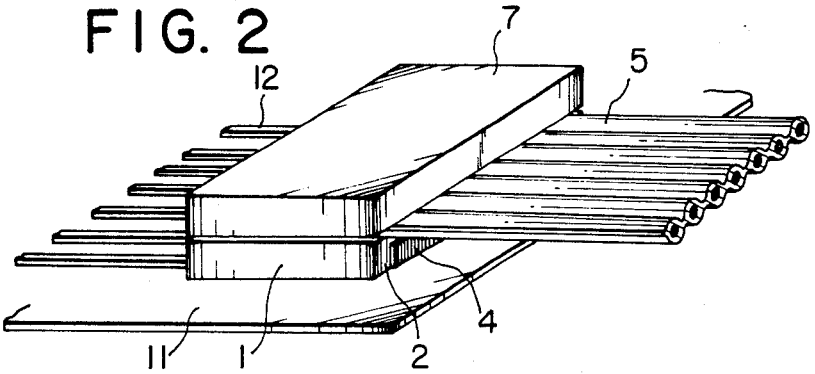
FIG. 2 is a perspective view of the inventive connector assembled holding a flat cable to connect it with a circuit board below it.
Figure 3:
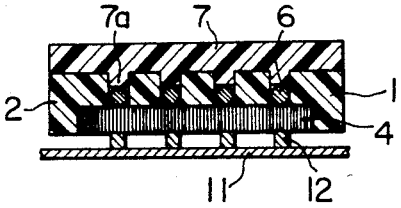
FIG. 3 is a cross sectional view of the connector with a flat cable held thereby to be connected with a circuit board.

The method for preparing such an anisotropically electroconductive sheet 4 is well known in the art. For example, an insulating polymeric material such as polyvinyl chloride, polyphenylene sulfide and the like thermoplastic resins, phenolic resin, unsaturated polyester resin, melamine resin and the like thermosetting resins and natural rubber, ethylene-propylene copolymeric rubber, silicone rubber and the like elastomers is blended with electroconductive fibers such as carbon fibers, graphite fibers and metal fibers as well as metal-plated organic synthetic fibers and glass fibers and the blend is shaped under a unidirectional shearing by a method such as extrusion molding, injection molding and calendering with simultaneous orientation of the fibers in the direction of the shearing force. Since the electric connection between the end portion of one of the cable wires 6 and one of the terminals 12 on the circuit board 11 is obtained through this sheet 4 as is illustrated in FIGS. 2 and 3, it is preferable that the matrix polymer of the anisotropically conductive sheet 4 has rubbery elasticity in order to ensure reliability in the connection. A preferable rubbery material is a silicone rubber in respect of the excellent electric properties and the electroconductive fibers are preferably metal fibers. The thickness of the sheet 4 is preferably in the range from 0.05 to 5 mm and the sheet should be as large as to cover all of the slots 3 of the base plate 1 which extends usually over a width of 10 to 70 mm according to the width of the flat cable 5.

The anisotropically conductive sheet 4 may be fixed to the lower surface of the base plate 1 by merely pressing between the frame-like raised ends 2,2 of the base plate 1 but it is preferable that the sheet 4 is adhesively bonded to the base plate 1 by use of a suitable adhesive such as a cyanoacrylate adhesive or a rubbery adhesive depending on the materials of the base plate 1 and the matrix polymer of the sheet 4.

As is mentioned before, each of the exposed ends of the cable wires 6 of the flat cable 5 is put into one of the slots 3 in the base plate 1 and fixedly held in the place by covering with a cover member 7 made of an insulating material as is illustrated in FIGS. 2 and 3. Correct positioning of the cover member 7 on the base plate 1 is facilitated by inserting the leg pins 8 provided, for example, at the corners of the cover member 7 into the respective holes 9 at the corners in the base plate 1. It is further preferable that the cover member 7 is provided on the lower surface thereof with one or more of spike pins 10 which, when the cover member 7 is put on the base plate 1 with the flat cable 5 therebetween, are thrusted into the base plate 1 piercing the flat cable 5 to ensure more firm positioning of the flat cable 5 at the right position between the base plate 1 and the cover member 7. Moreover, several projections *7a* are raised on the lower surface of the cover member 7 each to just fit one of the slots 3 in the base plate 1 as is shown in FIG. 3 when the cover member 7 is placed on the base plate 1 to press the cable wire 6 in the slot 3 toward the anisotropically conductive sheet 4 on the other side of the base plate 1 so that the reliability in the contact between the cable wires 6 and the sheet 4 can be increased. Although the leg pins 8 are provided to the cover member 7 and the holes 9 to fit the leg pins 8 are provided in the base plate 1 in the embodiment illustrated in FIG. 1, it is of course optional to provide the leg pins on the base plate 1 and the holes to fit the leg pins are provided in the cover member 7.

The connector thus holding the flat cable 5 with electric connection between each of the exposed ends of the cable wires 6 of the flat cable 5 and the anisotropically conductive sheet 4 is then brought into contact with the terminals 12 on a circuit board 11 at the lower surface of the sheet 4 by clamping or other suitable means so that reliable electric connection is obtained between each of the cable wires 6 and one of the terminals 12 oppositely positioned on the upper and lower sides of the sheet 4, respectively, by virtue of the anisotropic electric conduction of the sheet 4 while the insulation between the terminals 12 is retained. This situation can well be understood from FIG. 3.

In short, the above described connector for flat cables according to the invention is very advantageous not only in the high reliability of the electric connection established between the cable wires of the flat cable and the terminals on a circuit board but also in the outstanding simplicity of the structure which in turn gives an economical advantage due to the cost decrease in the manufacture of the connector per se and saving of the expense of plating with gold to prevent corrosion of the metal-made parts.

What is claimed is:

1. A socket-type connector for flat cables which comprises a base plate made of an electrically insulating material and provided with a plurality of slots running in parallel with each other, an anisotropically electroconductive sheet applied or bonded to one surface of the base plate to cover the slots therein, the direction of the anisotropic electric conduction of the said sheet being substantially perpendicular to the surface of the sheet, and a cover member to fit the other surface of the base plate made of an electrically insulating material.

2. The socket-type connector as claimed in claim 1 wherein the anisotropically electroconductive sheet is formed of an electrically insulating polymeric material as the matrix and electrically conductive fibers dispersed in the matrix in orientation in the direction substantially perpendicular to the surface of the sheet.

3. The socket-type connector as claimed in claim 1 wherein the cover member is provided with a plurality of protrusions on the surface in contact with the surface of the base plate when the cover member is placed on the base plate, each of the protrusions being in the form and at the position to just get into one of the slots in the base plate when the cover member is placed on the base plate.

4. The socket-type connector as claimed in claim 1 wherein the cover member is provided with at least one spike pin on the surface coming into contact with the base plate when the cover member is placed on the base plate, the said spike pin being thrusted into the base plate.

* * * * *